United States Patent [19]

Woloszyn

[11] 4,306,470

[45] Dec. 22, 1981

[54] JAR OPENER

[76] Inventor: Wolodymyr Woloszyn, 3033 Bertha St., Flint, Mich. 48504

[21] Appl. No.: 78,153

[22] Filed: Sep. 24, 1979

[51] Int. Cl.[3] ..... B67B 7/00

[52] U.S. Cl. ..... 81/3.42; 81/128

[58] Field of Search ..... 81/3.42, 128, 180 B, 81/185, 3.2, 3.3 R, 3.3, 3.4, 3.44; 269/268, 280

[56] References Cited

U.S. PATENT DOCUMENTS

| | | | |
|---|---|---|---|
| 1,652,221 | 12/1927 | Trout | 81/186 X |
| 2,249,786 | 7/1941 | Sacerdote | 81/128 |
| 2,486,523 | 11/1949 | Deschenes | 81/3.42 |
| 2,569,239 | 9/1951 | Holmen | 81/3.42 X |
| 2,634,638 | 4/1953 | Krag | 81/3.42 |
| 2,651,957 | 9/1953 | Phillips | 81/3.42 X |
| 2,669,142 | 2/1954 | Fuller | 81/3.42 |
| 2,714,321 | 8/1955 | Tamplin | 81/180 B X |
| 2,719,444 | 10/1955 | Zeller | 81/3.42 |
| 4,052,917 | 11/1977 | Gee | 81/3.42 |
| 4,230,000 | 10/1980 | Downs | 81/3.2 |

FOREIGN PATENT DOCUMENTS

| | | | |
|---|---|---|---|
| 589740 | 6/1947 | United Kingdom | 81/3.42 |

*Primary Examiner*—James G. Smith

*Attorney, Agent, or Firm*—Gifford, VanOphem, Sheridan & Sprinkle

[57] ABSTRACT

A screw cap remover having an elongated handle, a first semicircular jaw secured to a first end of the handle, and a second semicircular jaw axially slidable along the handle. A tubular sleeve slides along the elongated handle and has the second jaw secured at a first end thereof. The second end of the sleeve is adapted to abut against a rotatable cam member, the rotation of which axially displaces the tubular member and thus, the second jaw, toward the first jaw. The rotatable cam member is adapted to be positioned at several discrete positions along the elongated handle and the jaws are detachably secured to the handle so that jaws of a size corresponding to the size of the screw cap can be easily installed or replaced.

5 Claims, 5 Drawing Figures

JAR OPENER

BACKGROUND OF THE INVENTION

I. Field of the Invention

The present invention relates generally to screw cap removers and more particularly to such a device having adjustable and removable jaws so as to be able to lockingly engage many sizes of screw caps around substantially the entire periphery of the screw cap.

II. Description of the Prior Art

There are many types of previously-known devices for removing screw cap lids from a container. These devices are generally provided with a pair of cap engaging jaws adapted to engage diametrically opposed sides of the cap. The jaws are secured to an elongated handle so that the handle extends radially outwardly from the screw cap and thus provides leverage which enables a large torque to be exerted upon the screw cap.

U.S. Pat. Nos. 2,719,444, 2,669,142, 2,651,957, and 2,634,638 disclose such screw cap movers wherein a lever is pivotable with respect to the elongated handle of the device such that pivoting of the lever urges a slidable jaw toward a fixed jaw secured to the elongated handle in order to grip the screw cap between the jaws. One disadvantage of these previously-known devices is that when pressure is applied to the elongated handle to cause rotational movement of the screw cap, the lever is simultaneously urged toward the handle and thus the sliding jaw is subjected to excess forces which urge it into tighter contact with the screw cap lid. Such excess forces can cause deformation of the screw cap lid and even breakage of the container upon which the screw cap is secured.

The U.S. Pat. No. 2,486,523 discloses a screw cap wrench having an elongated handle and a ring member secured at one end of the handle, wherein a pivoting cam member urges a sliding jaw toward a stationary jaw. The stationary jaw includes a plurality of teeth along a portion of the inner periphery of the ring member facing the sliding jaw. Such a construction is disadvantageous in that the ring strictly limits the size of the screw cap with which the wrench can be used. Moreover, the size of the screw cap with which the wrench is operable is also limited by placement of the pivot pin of the cam member with respect to the wrench handle. In addition, as with the other previously-known screw cap wrenches, the size of the jaws is not adjustable. Thus, although some of the jaws disclosed in previously-known screw cap removers are designed so that they can grip at least a portion of the screw cap regardless of the diameter of the screw cap, the jaw exerts its force only at discrete points around the periphery of the screw cap. Consequently, the screw cap is subjected to forces which are concentrated at particular points around the periphery of the screw cap and these forces can deform the concentricity of the screw cap. Moreover, the points of concentrated stress subject the container to which the screw cap is secured to possible deformation or breakage.

SUMMARY OF THE PRESENT INVENTION

The present invention overcomes the above-mentioned disadvantages by providing a screw cap removal device having an elongated handle, a stationary jaw, and a sliding jaw, wherein the spacing between the jaws is infinitely variable so as to permit an engagement with screw caps throughout a wide range of screw cap diameters. In addition, the jaws are detachably secured to the handle so that jaws having a radius substantially the same as the screw cap lid can be installed to provide a gripping engagement between the jaws and the periphery of the screw cap around substantially the entire screw cap. A rotatable cam member urges the sliding jaw toward the stationary jaw and controls the force with which the jaws engage and grip the screw cap.

The first semicircular jaw is detachably secured to one end of the elongated handle while the second jaw is detachably and axially slidably mounted to the elongated handle. The rotatable cam member is secured to the elongated handle so that rotation of the cam member axially urges the second jaw towards the first jaw. Preferably, the cam member is adjustably mounted to the handle at one of a plurality of equally spaced and preset positions along the length of the elongated handle. The position of said cam member is dependent upon the size of the screw cap lid to be removed as will become hereinafter apparent. Moreover, the cam surface of the cam member is designed to provide an axial displacement of the second jaw slightly greater than the distance between said discrete cam member positions on the handle when the cam member is rotated, preferably through substantially 270°.

The means for detachably securing the first and second jaws to the elongated handle preferably comprises a first bracket secured to the outer periphery of each jaw and a second bracket secured to the handle or a portion thereof, wherein each bracket is provided with a registering aperture to permit insertion of a fastener, such as a cotter pin, therethrough.

BRIEF DESCRIPTION OF THE DRAWINGS

The present invention will be more clearly understood by reference to the following detailed description when read in conjunction with the accompanying drawing wherein like reference characters refer to like parts throughout the several views and in which.

DETAILED DESCRIPTION OF THE PRESENT INVENTION

Figure 1:
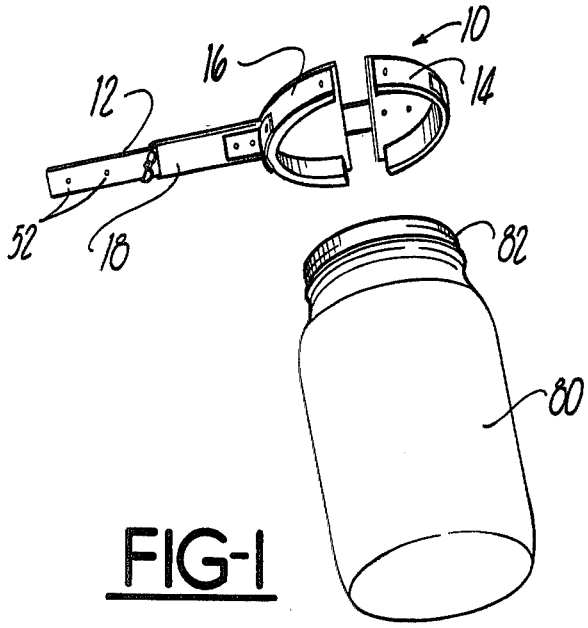
FIG. 1 is a perspective view of the device of the present invention.

Referring now to FIG. 1 the device 10 of the present invention is thereshown and comprises an elongated handle 12, a first semicircular jaw 14 and a second semicircular jaw 16. An elongated sleeve 18 is axially slidably mounted to the handle 12. The first jaw 14 is secured to one end of the elongated handle 12 and the second jaw 16 is secured to the sleeve 18 in a manner to be hereinafter described.

Figure 4:
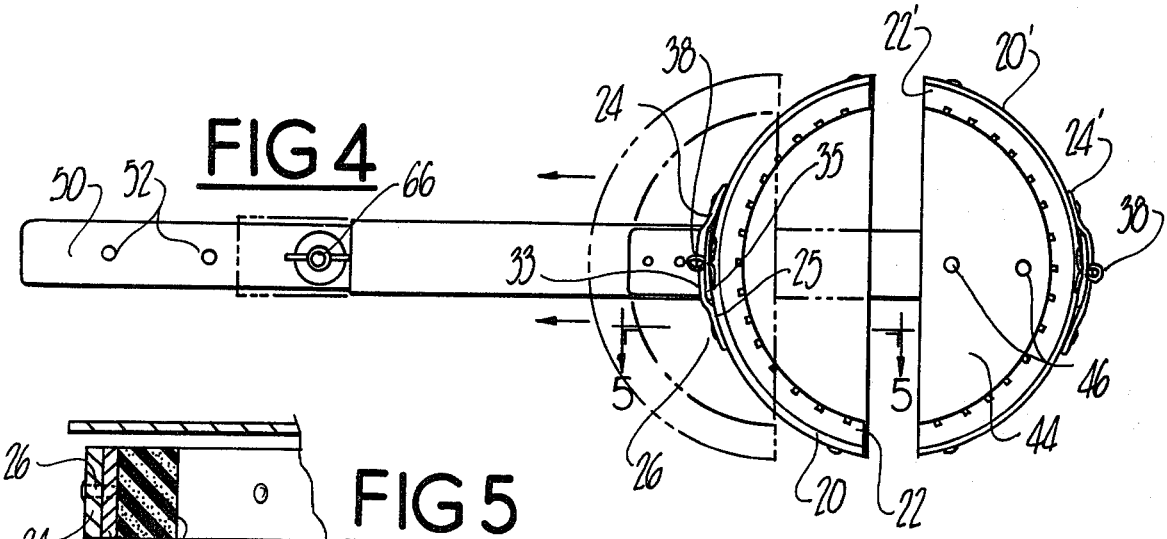
FIG. 4 is a bottom view of the device of the present invention.
Figure 5:
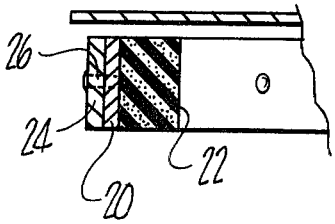
FIG. 5 is a fragmentary sectional view taken substantially along the line 5—5 in FIG. 4 and enlarged for clarity.

As best shown in FIGS. 4 and 5, each jaw 14 and 16 is substantially identical to the other. Thus only parts of the jaw 16 will be described in detail although later reference to similar parts of jaw 14 will be indicated by 37 '". As illustrated in FIGS. 4 and 5, the jaw 16 comprises a semicircular wall member 20 having a concentric gripping member 22 secured along its inner periphery by appropriate means such as glue, rivets, or the like. The gripping member 22 is preferably made of pliable but resilient material such as rubber.

An elongated support bracket 24 is secured between the ends of the wall member 20 to the outer surface of the wall member 20. The end portions 25 of the bracket 24 flatly abut against the outer periphery of the semicircular wall member 20 while the central portion 33 of the bracket 24 is spaced radially away from the outer periphery of the wall member 20 for a reason which will hereinafter become apparent. The end portions 25 of the bracket 24 are secured to the wall member 20 by appropriate fastening means such as the rivets 26.

Figure 3:
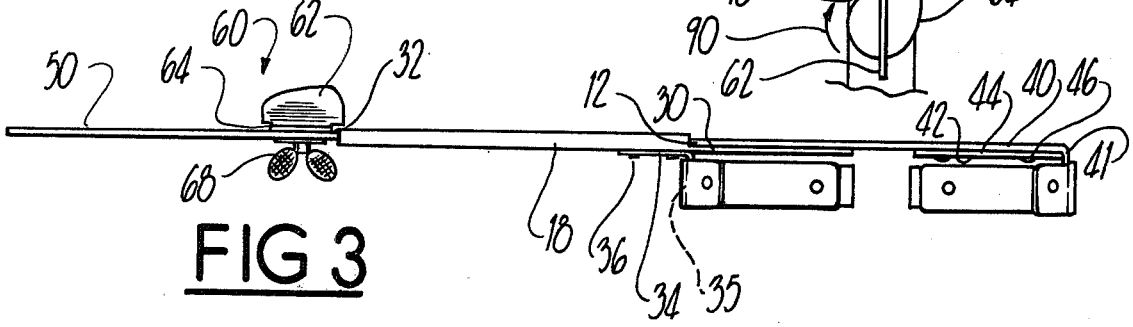
FIG. 3 is a side view of the device of the present invention.

As best shown in FIG. 3, the sleeve 18 comprises a substantially tubular member slidably mounted over the handle 12. The lower surface of the sleeve is extended at one end and forms a stop plate 30 which limits the depth to which a screw cap 82 (FIG. 1) can be inserted into the jaws 14 and 16. The other end of the sleeve 18 has an edge 32 which acts as a cam race in a manner to be hereinafter explained. A substantially L-shaped bracket 34 is secured to the lower surface of the sleeve 18 so that as one leg is secured to the sleeve 18, such as by the rivets 36 or the like, the other leg 35 (FIG. 4) of the bracket 34 depends downwardly from the sleeve 18. The downwardly depending leg 35 of the bracket 34 is slidably receivable between the central portion 33 of the bracket 24 and the wall member 20 of jaw 16. The depending leg of the bracket 34 and the central portion 35 of the bracket 24 are provided with registering apertures so that fastening means, such as the cotter pin 38 (FIG. 4), can releasably lock the brackets 24 and 34 together.

Referring now to FIGS. 3 and 4, a bracket 42 is secured to an end 40 of the handle 12. The bracket 42 preferably includes an upper leg 44 having substantially the same shape as the end portion 30 of sleeve 18 so that the bracket 42 acts as a rest stop in the same manner as the portion 30 of sleeve 18. In any event, the leg 44 is secured to the end 40 of the elongated handle 12 by appropriate means such as the rivets 46. A depending leg 41 of the bracket 42 is slidably receivable between the wall member 20' and the center portion 33' of the bracket 24' of the jaw 14. Both the depending leg 41 of the bracket 42 and the center portion 33' of the bracket 24' have registering apertures so that an appropriate fastener such as the cotter pin 38' can be used to lock the brackets 42 and 24' together.

Figure 2:
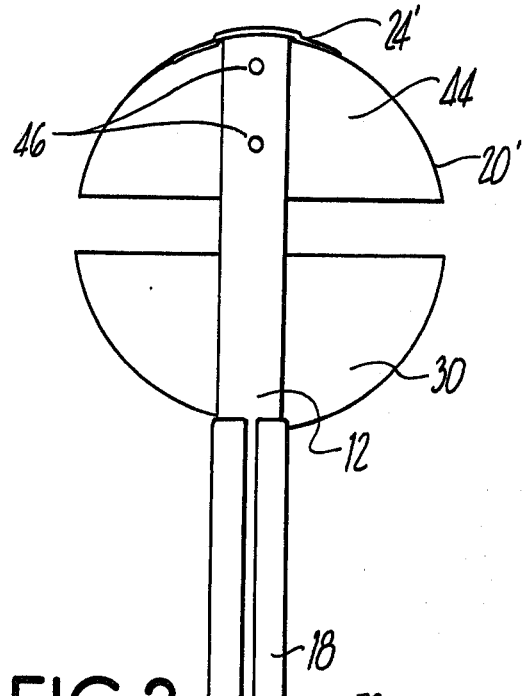
FIG. 2 is a fragmentary top plan view of the device of the present invention.

Referring to FIGS. 2–4, the other end 50 of the elongated handle 12 has a plurality of longitudinally spaced throughbores 52. A rotatable cam member 60 comprises a rib-like handle portion 62, a cam surface 64 and an elongated stem 66 which is positioned through one of the throughbores 52 in the handle 12. Preferably, the lower end of the stem 66 is threaded so that a wing nut 68 can be threadably secured thereto to retain the cam member 60 to the handle 12. The cam surface 64 abuts against the edge 32 of the sleeve 18 and extends from one end 70 of the cam surface 64 along a path of increasing radius toward the termination point 72 of the cam surface 64. Preferably, the difference between the radius of the cam surface at point 70 and the radius of the cam surface at point 72 is slightly greater than the distance between adjacent throughbores 52 so that axial displacement of the edge 32 by rotation of the cam member 60 is at least as great as the distance between adjacent throughbores 52. The handle portion 62 of the cam member 60 can be easily grasped between the thumb and the forefinger of one hand so that the cam member 60 can be easily manually rotated.

The operation of the device of the present invention can now be described first with reference to FIG. 1. In FIG. 1 the container 80 is thereshown having its screw cap 82 which is to be removed utilizing the device 10. Appropriate jaws 14 and 16 are selected so as to conform with the circumference of the screw cap 82. Preferably, the radius of the inner edge of the gripping material 22 is slightly less than the radius of the outer periphery of the screw cap 82 but the radius of the wall member 20 can be slightly greater than the radius of the screw cap 82. The appropriate jaws 16 and 14 are then secured to the wrench by sliding them onto the depending legs of the brackets 24 and 24' respectively and inserting a cotter pin 38 through the registering apertures in brackets 34, 24, and 42, 24' respectively. The sleeve 18 is then slidably adjusted along the handle 12 so that the jaws 16 and 14 loosely engage the periphery of the screw cap 80.

The cam member 60 is then secured to the handle 12 by inserting its stem 66 through one of the throughbores 52 in the handle 12. Preferably, the stem 66 is inserted in the throughbore 52 which is exposed but nearest to the edge 32 of sleeve 18, and the cam surface 64 is aligned so that a point near the point 70 abuts against the edge 32 of sleeve 18 while the jaws 14 and 16 loosely engage the screw cap. The wing nut 68 is then threaded onto the stem 66 to loosely secure the cam member 60 to the handle.

Rotation of the cam member 60 in the direction of arrow 90 in FIG. 2 displaces the edge 32 of sleeve 18 toward the end 40 of the elongated handle as the point 72 of cam surface 64 approaches the edge 32 of sleeve 18 until the jaws 14 and 16 tightly engage the screw cap. Since the difference in radius between the point 70 and the point 72 is greater than the distance between adjacent throughbores 52 of handle 12, the jaws 14 and 16 will be urged tightly against the periphery of screw cap 82 when the cam member 60 is rotated somewhere between the end points 70 and 72 of the cam surface 64.

Since the wall members 20, 20' and gripping members 22, 22' extend substantially around the entire periphery of the screw cap 82, a substantially uniform pressure is applied around the entire periphery of the screw cap 82, and thus, no concentrated points of excess stress are exerted upon the screw cap 82 or the container 80. Furthermore, although further rotation of the cam member toward the point 72 is resisted once the jaws 14 and 16 tightly engage the screw cap, the circumferential gripping of the jaws eliminates the need for an elongated lever to provide sufficiently tight engagement with the screw cap. Thus, the relatively short handle portion 62 of the cam member 60 is not only sufficient to provide the necessary gripping force, but it prevents the application of excess force upon the screw cap 82 and container 80.

Once the screw cap 82 is tightly engaged within the jaws 14 and 16, the handle 12 is grasped and rotated in a counterclockwise direction to thereby remove the screw cap 82.

Thus, the present invention provides a screw cap remover which can be adapted for use with any size screw cap. Moreover, since the jaws extend substantially around the entire periphery of the screw cap and because the jaws are easily detached and replaced with jaws having a different radius, a uniform engagement pressure as well as an evenly distributed torque can be exerted by the jaws upon the screw cap. In addition, no greatly excessive forces can be exerted upon or concentrated at particular points of the screw cap and the container.

Having thus described my invention, many modifications thereto will become apparent to those skilled in the art to which it pertains without departing from the spirit of the invention and the scope as defined in the appended claims.

I claim:

1. An adjustable screw cap remover comprising:

an elongated handle, said handle having a bracket fixedly secured at one end, said bracket having an outwardly extending leg, a sleeve slidably mounted to said handle, said sleeve having a bracket fixedly secured to the end of the sleeve closest to said one handle end, said sleeve bracket having an outwardly extending leg, a pair of substantially identical semicircular jaws and means for detachably securing one jaw to each of said outwardly extending bracket legs, each jaw having a central portion spaced outwardly from the outer periphery of the jaw and forming a slot therebetween and into which one bracket leg is received, said handle having a plurality of longitudinally spaced holes formed along its length, a cam member having a stem and means for detachably rotatably mounting said cam member stem to said handle at any of said handle holes, said cam member having a cam surface which abuts against the other end of the sleeve, and a handle portion integrally formed with said cam member.

2. The invention as defined in claim 1 wherein said stem of said cam member is threaded and wherein said remover further comprises a wing nut adapted to threadably engage said stem of said cam member.

3. The invention as defined in claim 1 wherein said cam surface has a continuously increasing radius between two circumferential points and wherein the difference in radius between said two circumferential points is slightly greater than the distance between said axially spaced throughbores.

4. The invention as defined in claim 1 wherein said detachable securing means comprises a cotter pin.

5. The invention as defined in claim 1 wherein each jaw further comprises an arcuate wall member and a concentric arcuate gripping member, said gripping member being constructed of a resilient material.

* * * * *

UNITED STATES PATENT AND TRADEMARK OFFICE

CERTIFICATE OF CORRECTION

PATENT NO. : 4,306,470

DATED : December 22, 1981

INVENTOR(S) : Wolodymyr Woloszyn

It is certified that error appears in the above-identified patent and that said Letters Patent are hereby corrected as shown below:

In the Abstract, line 9, first occurrence, delete "the" and insert --said-- therefor.

Column 2, line 67, delete "37'"" " and insert --"'"-- therefor.

Signed and Sealed this

Fourth Day of May 1982

[SEAL]

Attest:

GERALD J. MOSSINGHOFF

Attesting Officer

Commissioner of Patents and Trademarks